US011624138B2

(12) United States Patent
Kim et al.

(10) Patent No.: US 11,624,138 B2
(45) Date of Patent: Apr. 11, 2023

(54) LAUNDRY APPARATUS AND CONTROL METHOD THEREOF

(71) Applicant: LG Electronics Inc., Seoul (KR)

(72) Inventors: Changoh Kim, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 245 days.

(21) Appl. No.: 16/654,479

(22) Filed: Oct. 16, 2019

(65) Prior Publication Data

US 2020/0115837 A1 Apr. 16, 2020

(30) Foreign Application Priority Data

Oct. 16, 2018 (KR) ..... 10-2018-0123453

(51) Int. Cl.
*D06F 33/00* (2020.01)
*D06F 39/04* (2006.01)
(Continued)

(52) U.S. Cl.
CPC ..... *D06F 33/00* (2013.01); *D06F 39/04* (2013.01); *D06F 39/087* (2013.01);
(Continued)

(58) Field of Classification Search
None
See application file for complete search history.

(56) References Cited

U.S. PATENT DOCUMENTS

2004/0244433 A1* 12/2004 Lee ..... D06F 39/087 68/12.13
2008/0034809 A1* 2/2008 Bang ..... D06F 33/34 68/12.21
(Continued)

FOREIGN PATENT DOCUMENTS

DE 3623516 3/2020
EP 1961854 8/2008
(Continued)

OTHER PUBLICATIONS

Derwent Method for treating laundry in a front loading washing machine, DE102009026646 A1, Steffens (Year: 2010).*
(Continued)

*Primary Examiner* — Cristi J Tate-Sims
(74) *Attorney, Agent, or Firm* — Fish & Richardson P.C.

(57) ABSTRACT

Disclosed herein are a laundry apparatus for heating a drum by an induction heater and a control method thereof. According to an embodiment, the method of controlling a laundry apparatus including a tub, a drum, an induction heating module mounted on the tub to heat the drum, and a circulation pump configured to pump wash water from the tub to an upper portion of the drum includes supplying wash water into the tub through a water supply valve, circulating the wash water by operating the circulation pump and performing fabrics soaking by driving the drum, performing heating by the induction heating module after termination of the fabrics soaking, and performing washing by driving the drum, wherein a water level of the wash water at the termination of the fabrics soaking is lower than a water level of the wash water at the termination of the water supply.

26 Claims, 11 Drawing Sheets

(51) Int. Cl.

| | |
|---|---|
| ***D06F 39/08*** | (2006.01) |
| *D06F 103/16* | (2020.01) |
| *D06F 103/18* | (2020.01) |
| *D06F 105/06* | (2020.01) |
| *D06F 105/46* | (2020.01) |

(52) U.S. Cl.
CPC ..... *D06F 39/088* (2013.01); *D06F 2103/16* (2020.02); *D06F 2103/18* (2020.02); *D06F 2105/06* (2020.02); *D06F 2105/46* (2020.02)

(56) References Cited

U.S. PATENT DOCUMENTS

| | | | | |
|---|---|---|---|---|
| 2008/0134445 | A1* | 6/2008 | Cho | D06F 33/32 8/149.1 |
| 2009/0272155 | A1* | 11/2009 | Jeong | D06F 39/008 68/5 C |
| 2011/0099732 | A1* | 5/2011 | Im | D06F 37/306 8/137 |
| 2011/0126360 | A1 | 6/2011 | Cho et al. | |

FOREIGN PATENT DOCUMENTS

| | | |
|---|---|---|
| EP | 2578736 | 4/2013 |
| EP | 2792782 | 10/2014 |
| EP | 2930262 | 10/2015 |
| EP | 3246451 | 11/2017 |
| JP | 2009050639 | 3/2009 |
| JP | 2012030002 | 2/2012 |
| KR | 1020060124221 | 12/2006 |
| KR | 1020080079071 | 8/2008 |
| KR | 1020110016224 | 2/2011 |
| WO | WO2019164244 | 8/2019 |

OTHER PUBLICATIONS

Extended European Search Report in European Application No. 19203140.9, dated Feb. 4, 2020, 11 pages.
PCT International Search Report and Written Opinion in International Application No. PCT/KR2019/013345, dated Feb. 11, 2020, 11 pages.
Office Action in European Appln. No. 19203140.9, dated Oct. 21, 2021, 10 pages.

* cited by examiner

FIG. 10

| Washing Performance | 95%↓ | | 97%↓ | | 100% | | 95% | |
|---|---|---|---|---|---|---|---|---|
| Amount of Water | X | | 0~1ℓ | | 2~4ℓ | | 5ℓ~ | |
| Washing Temperature | X | | X | | 40℃ | | 34℃ | |
| Circulation | X | X | X | X | X | X | O | O |
| Motion | | | | | | | | |

FIG. 11

| Washing Performance | 98% | | 103% | | 100% | | 95% | |
|---|---|---|---|---|---|---|---|---|
| Amount of Water | X | | 0~1ℓ | | 2~4ℓ | | 5ℓ~ | |
| Washing Temperature | 58℃ | | 52℃ | | 40℃ | | 34℃ | |
| Circulation | X | X | X | O | O | O | O | O |
| Motion | | | | | | | | |

LAUNDRY APPARATUS AND CONTROL METHOD THEREOF

CROSS-REFERENCE TO RELATED APPLICATION

This application claims the benefit of Korean Application No. 10-2018-0123453, filed on Oct. 16, 2018. The disclosure of the prior application is incorporated by reference in its entirety.

BACKGROUND OF THE INVENTION

Field of the Invention

The present invention relates to a laundry apparatus, and more particularly, to a laundry apparatus for heating a drum by an induction heater and a control method thereof.

Discussion of the Related Art

The laundry apparatus includes a tub (an outer tub) configured to store wash water and a drum (an inner tub) rotatably provided in the tub. Laundry (fabrics) is provided inside the drum, and the fabrics are washed with a detergent and wash water while the drum rotates.

In order to enhance the washing effect by promoting the activation of the detergent and decomposition of contaminants, hot wash water is supplied into the tub or heated inside the tub. To this end, the bottom of the inside of the tub is generally recessed downward to form a heater mounting portion, a heater is provided in the heater mounting portion. Such heaters are generally sheath heaters.

When washing is performed with cold water, the heater is not driven. However, for normal washing, the temperature of the wash water is set to 40 degrees Celsius or a higher temperature. Thus, in many cases, the heater is driven during washing.

The amount of wash water needed for washing may be determined by the amount of wash water needed for a heater protection water level and the amount of wash water needed for fabrics soaking.

First, approximately 6 liters of wash water should be supplied to ensure the heater protection water level for the heater at which the heater is completely submerged. In the absence of fabrics, approximately 6 liters of wash water is supplied to the tub such that the heater is completely submerged in the wash water and a part of the lower portion of the drum is also submerged in the wash water.

Second, more wash water is needed for fabrics soaking as well as heater protection. In general, the amount of water that the fabrics keep therein when water is supplied is about 200% of the amount of fabrics. Therefore, as the amount of water increases, the amount of wash for fabrics soaking increases. Approximately 6 liters of wash water will be needed for soaking of approximately 3 kg of fabrics.

As water starts to be supplied for washing, soaking of fabrics is performed. After water supply is finished, fabrics soaking is performed in earnest and then finished. Even during fabrics soaking, water may continue to be supplied to meet the heater protection water level. Water supply during the fabrics soaking may be additional water supply so as to be distinguished from the water supply before the fabrics soaking. The amount of wash water needed to reach the heater protection water level with the fabrics completely soaked is approximately 6 liters.

Thus, to wash 3 kg of fabrics, approximately 12 liters of wash water is needed. Of course, this amount of wash water is the amount needed for one washing cycle. The amount of wash water required for rinsing when water is drained after washing correspond to separate water.

In order to enhance the washing effect, a laundry apparatus having a wash water circulation system is provided. The circulating system is a system configured to drain wash water from the tub through a circulation pump and then spraying the same back into the drum. Thus, the circulation system may include a flow channel and a spray nozzle, which constitute a circulation path, as well as the circulation pump. Detergent-dissolved wash water may be sprayed onto the fabrics in the drum through the circulation system, thereby further enhancing the washing effect.

However, for a laundry apparatus adopting the circulation system, more wash water may be needed for circulation of the wash water. This is because there is wash water present on the circulation path running from a point at which wash water is supplied from the outside of the tub to a point at which the wash water is sprayed into the drum. Therefore, wash water as much as the wash water on the circulation path needs to be further supplied to meet the heater protection water level.

Approximately 1.5 liters of additional wash water are needed for circulation of the wash water. Therefore, to wash 3 kg of fabrics, 12 to 13.5 liters of wash water or more is needed. When the water level of the wash water is sensed using a frequency, the water level frequency at the heater protection water level is lower than or equal to approximately 24.7 KHz. As the water level frequency increases, the water level is lowered.

FIG. 1 shows the relationship between a washing step and an actual operating rate of the drum in a laundry apparatus having a wash water heater and a circulation pump. In the laundry apparatus, driving of the drum and driving of the circulation pump may be synchronized. Therefore, the actual operating rate of the motor may be equal to the actual operating rate of the circulation pump.

At the initial stage of washing, water supply and fabrics soaking may be performed. In this operation, the drum may be tumbled. Tumbling may be performed through forward and reverse rotation, and the RPM of the drum during tumbling is approximately 40 RPM. When more than 1.5 liters of wash water is supplied after the initial water supply, soaking of fabrics is carried out and water continues to be supplied as the tumbling begins.

Since the drum is driven to tumble, the fabrics are stirred by being repeatedly lifted up and then falling inside the drum. Thereby, soaking of fabrics is facilitated. In addition, circulation of the wash water may be carried out in the operation of fabrics soaking to further promote fabrics soaking. Then, water supply and fabrics soaking are performed until the water level of the wash water is no longer changed at the heater protection water level. That is, the fabrics soaking may be performed until the fabrics are completely wet as not to absorb wash water anymore.

When the water supply and fabrics soaking are completed, the wash water heater is driven to heat the supplied wash water. The motor actual operating rate is designed to be the minimum when the wash water is heated. The motor is designed to have an actual operating rate of approximately 13%. That is, the time for which the motor is driven may be designed to be approximately 13% of the entire heating period. Minimum tumbling is needed to evenly heat the fabrics and the wash water.

As the drum rotates, a portion of the wash water rotates along with the drum. That is, scattering of the wash water may occur, and the heater may be exposed to the air due to slopping water. The heater protection water level is not kept due to exposure of the heater to the air. For this reason, tumbling is needed during heating, but the actual operating rate is set to a minimum to maintain the heater protection water level. As a result, the actual operating rate during the heating period is very low compared to that in the period of fabrics soaking or the main washing period.

Since the time required to perform tumbling in the heating period is minimized, the washing effect in the heating period is not remarkable. That is, the washing time is increased by the time required for heating, and the heating time cannot be used in securing washing performance.

In addition, driving the circulation pump is stopped in the heating period. That is, driving of the circulation pump is not synchronized with driving of the drum and the actual operating rate of the circulation pump in the heating period may be 0%. This is because when the circulation pump is driven, about 1.5 liters or more of wash water should be additionally supplied as described above. In addition, the heater protection water level may be destroyed by the driving of the circulation pump and the tumbling driving.

It is not desirable to supply additional water to drive the circulation pump or increase the actual operating rate in the heating period. This is because the detergent concentration is lowered when the amount of supplied wash water is increased compared to a predetermined amount of detergent. That is, the washing performance may be slightly increased through circulation and a high actual operating rate in a relatively short period called the heating period. However, since the concentration of the detergent is low, the washing performance may be significantly reduced in the main washing period.

Once the wash water is heated up to a target temperature, the drum is driven at an actual operating rate of approximately 70%, and washing is performed in earnest. In the main washing, the circulation pump may be driven.

Accordingly, for typical laundry apparatuses, a relatively large amount of wash water is needed to meet the heater protection water level. Therefore, it is difficult to perform washing through high-concentration detergent water (wash water in which detergent is dissolved), or a large amount of detergent is needed. In addition, in order to meet the heater protection water level, the degree of freedom of the actual operating rate of the drum or the circulation pump in the heating period is inevitably limited. Therefore, the washing time is relatively increased.

Therefore, there are large requirements for saving wash water, reducing detergent, performing washing by high-concentration detergent water, reducing the heating time, saving energy by improving the degree of freedom of the motor and circulation pump, and reducing the washing time.

SUMMARY OF THE INVENTION

The present invention basically aims to address the issues of the conventional laundry apparatus.

In one embodiment of the present invention, a laundry apparatus capable of increasing efficiency of fabrics soaking by driving a circulation pump in a period of fabrics soaking even when the amount of supplied wash water is small, and a control method thereof are provided.

In one embodiment of the present invention, a laundry apparatus capable of shortening the time required for fabrics soaking while effectively performing fabrics soaking, and a control method thereof are provided.

In one embodiment of the present invention, a laundry apparatus capable of improving washing performance and reducing energy consumption by increasing the actual operating rate of a drum and the actual operating rate of a circulation pump in a wash water heating period by destroying a heater protection water level, and a control method thereof are provided.

In one embodiment of the present invention, a laundry apparatus capable of enhancing washing performance by driving a circulation pump in a wash water heating period, and a control method thereof are provided.

In one embodiment of the present invention, a laundry apparatus capable of securing washing performance and saving energy by reducing energy needed to heat wash water, and a control method thereof are provided.

In one embodiment of the present invention, a laundry apparatus capable of performing washing using a small amount of wash water and high-concentration detergent water, and a control method thereof are provided.

In one embodiment of the present invention, a laundry apparatus capable of safely heating wash water despite the destruction of a heater protection water level, and a control method thereof are provided.

In one embodiment of the present invention, a laundry apparatus capable of heating a drum through an induction heating module and heating wash water through the heated drum, and a control method thereof are provided.

In one embodiment of the present invention, a safe laundry apparatus that prevents overheating through an induction heating module and a control method thereof are provided. In addition, a laundry apparatus capable of enhancing the heating efficiency and washing efficiency by increasing a time for which the induction heating module is driven (i.e., an actual operating rate of the induction heating module) in a heating period, and a control method thereof are provided.

In one embodiment of the present invention, a laundry apparatus capable of preventing an induction heating module from overheating a drum by controlling driving of the drum and the circulation pump to operatively connected to each other, in particular by operatively connecting the driving of the drum with the driving of the circulation pump, and a control method thereof are provided.

In one embodiment of the present invention, a safe laundry apparatus capable of forcibly stopping driving an induction heating module when overheating of the drum is sensed through a drying temperature sensor for detecting overheating of the drum, and a control method thereof are provided. In particular, a laundry apparatus capable of quickly addressing overheat of the drum by maintaining scheduled driving of the drum and/or the circulation pump when the induction heating module is forcibly stopped, and a control method thereof are provided.

In one embodiment of the present invention, a safe laundry apparatus capable of preventing overheating by the induction heating module through a drying temperature sensor and a wash water temperature sensor for detecting the temperature of wash water, which are installed at different positions, targeting different objects, and operate at different sensing times, and a control method thereof are provided.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry apparatus including a tub, a drum, an induction heating module mounted on the tub to heat the drum through induction heating, and a circulation pump configured to pump wash water inside the tub and supply the pumped wash water to an upper portion of the drum, and a control method thereof are provided.

In an aspect of the present invention, provided herein is a method of controlling the laundry apparatus, including a water supply step of supplying wash water into the tub through a water supply valve, a fabrics soaking step of circulating the wash water by operating the circulation pump and performing fabrics soaking by driving the drum after termination of the water supply step, a heating step of performing heating by driving the induction heating module after termination of the fabrics soaking step, and a main washing step of performing washing by driving the drum after termination of the heating step, wherein a water level of the wash water at the termination of the fabrics soaking step is lower than a water level of the wash water at the termination of the water supply step.

The laundry apparatus may perform a washing procedure by sequentially performing a washing operation, a rinsing operation, and a spin-drying operation. In the washing operation, the water supply step, the fabrics soaking step, the heating step, and the washing step may be sequentially performed and terminated.

In the water supply step, water may be supplied above a water supply water level, wherein a part of a lower portion of the drum may be submerged in the wash water at water supply water level. In the water supply step, water is supplied for soaking the fabrics, and therefore a sufficient amount of wash water should be supplied such that the fabrics are completely wet.

In the water supply step, water supply through a water supply valve may be performed a plurality of times such that a water level of the wash water rises step by step. In the initial round, water supply may be performed intermittently or discontinuously. In later rounds, water supply may be performed continuously.

The fabrics soaking step may include measuring a water level, wherein, when the water level measured in the measuring of the water level may be lower than a preset circulation water level, performing additional water supply.

The water level is lowered through the fabrics soaking step. This is because the fabrics absorb water.

In the fabrics soaking step, it is important to determine a water level at which additional water supply is needed or a water level at which additional water supply is terminated and the fabrics soaking step terminated. This is because, in the fabrics soaking step, the water supply is substantially terminated, and thus the wash water required for the washing operation may be determined in the fabrics soaking step. In addition, the water level in the fabrics soaking step may be equal to a subsequent heating water level.

For these reasons, in this embodiment, a circulation water level is presented as a reference water level in the fabrics soaking step.

The circulation water level may be a water level of the wash water formed by an amount of wash water smaller than or equal to an amount of wash water filling a circulation path for driving of the circulation pump. Specifically, the circulation water level may be a water level at which a lowest end of the drum is not submerged in the wash water. More specifically, the amount of wash water corresponding to the circulation water level may be less than 1.5 liters, and may be greater than about 1 liter.

Accordingly, the additional water supply may be performed until the circulation water level is reached. In addition, the additional water supply step may be performed at a zero water level at which the tub is substantially free of residual water. That is, when the zero water level is sensed in the tub during soaking of the fabrics, the additional water supply may be performed. The additional water supply may be performed until the circulation water level is reached.

In the measuring of the water level and the additional water supply, the driving of the drum and the circulation pump may be stopped. This is intended to accurately sense the level on the calm surface.

In this embodiment, in the fabrics soaking step, the wash water level may be lower than the lowest end of the drum except for the start time of the fabrics soaking. Therefore, in order to perform the fabrics soaking, the circulation pump may be driven to pump the wash water from below the tub to spray the wash water onto the top of the drum.

In the fabrics soaking step, the driving of the drum may include tumbling driving and filtration driving.

By the tumbling driving, the fabrics are evenly distributed and the function of turning over the fabrics is performed. This allows the fabrics to be evenly soaked. In addition, the wash water may be discharged from the fabrics at the same time the wash water is sprayed onto the fabrics that are wide spread through the filtration driving. That is, the wash water may penetrate the fabrics. Through the filtration driving, wash water necessary for the circulation of the wash water may be secured and the fabrics may be effectively soaked.

In the fabrics soaking step, the tumbling driving and the filtration driving may be performed sequentially and repeatedly. The filtration driving may enable the fabrics soaking to be performed by driving the circulation pump even with a small amount of wash water. In addition, the fabrics soaking may be further effectively performed through the tumbling driving.

In the fabrics soaking step, the driving of the drum may include circulation driving of performing tumbling driving and filtration driving in succession. In other words, two target RPMs may be given in one drum driving. The drum starting to rotate may be accelerated and driven at the tumbling RPM, and then accelerated again to maintain the rotation at the filtration RPM. When the motor is turned off at the filtration RPM, the drum will decelerate and stop. Accordingly, the tumbling driving and the filtration driving may be performed in succession.

In the fabrics soaking step, the circulation driving may be performed a plurality of times, and may be operatively connected to driving of the circulation pump.

An ON time of the motor for the circulation driving may be the same as an ON time of the circulation pump, and an OFF time of the motor for termination of the circulation driving may be the same as an OFF time of the circulation pump. That is, the ON period of the motor may be the same as the ON period of the circulation pump.

In the initial circulation driving, the wash water is sufficient to drive the circulation pump. Therefore, the tumbling driving may be performed in the earlier part of the period of the circulation driving and the filtration driving may be performed in the later part of the period of the circulation driving.

In the circulation driving, a time required for the tumbling driving may be longer than a time required for the filtration driving.

In the heating step and the main washing step, additional water supply through the water supply valve may be excluded. The final target water level in the water supply step is higher than the final target level in the fabrics soaking step. Water may be supplied in both the water supply step and the fabrics soaking step. Thereby, a time required to supply water in the washing operation may be reduced. Therefore, the overall washing time may be reduced.

The fabrics soaking step may be terminated when there is no change in a water level of the wash water after driving the drum and the circulation pump. That is, the fabrics soaking step may be terminated when the fabrics are completely soaked and there is no further decrease in the wash water level by the fabrics soaking.

The fabrics soaking step may be terminated at a circulation water level, the circulation water level being a water level of the wash water formed by an amount of wash water smaller than or equal to an amount of wash water filling a circulation path for driving of the circulation pump.

The heating step and the washing step may be performed at the circulation water level.

The water level of the wash water in the heating step is a water level at which a lowest end of the drum is submerged in the wash water.

The water level of the wash water in the heating step may be lower than or equal to a circulation water level formed by an amount of wash water smaller than or equal to an amount of wash water filling a circulation path for driving of the circulation pump.

In this embodiment, it is not necessary to maintain the water level to protect the heater. Accordingly, the circulation pump may be normally driven even with a minimum amount of wash water.

The amount of wash water stored in the tub in the heating step to form the circulation water level may be less than or equal to 1 liter. The minimum amount of wash water means that the total amount of wash water is small and thus high-concentration detergent water can be provided.

In the heating step, the drum, the circulation pump, and the induction heating module are driven.

The outer circumferential surface of the drum is heated by the induction heating module. At this time, the drum is rotated such that the drum is evenly heated. The drum is rotated and wash water is sprayed into the drum. Thus, not only the wash water but also the fabrics may be evenly heated.

Here, the objects to be heated by the induction heating module are substantially the drum, the wash water, and the fabrics. When it is assumed that the volume of the drum, the volume of the fabrics, and the amount of wash water contained in the fabrics to the maximum extent are the same, the heating efficiency may increase as the amount of residual wash water decreases. According to this embodiment, only residual wash water much less than the amount of residual wash water required for the heater protection water level is needed. Therefore, heating efficiency may be further enhanced.

A period for driving the drum may include a period for driving the circulation pump and the induction heating module. That is, the circulation pump and the induction heating module may be driven only when the drum is driven. It is effective to spray the wash water at this time because the fabrics in the drum move when the drum is driven. In addition, when the drum is driven, the induction heating module should be driven to prevent overheating of the drum and evenly heat the drum. In addition, the configuration is intended to heat the entire wash water including the residual wash water.

Accordingly, the driving of the circulation pump and the induction heating module may be excluded from a period in which the drum is not driven.

In the heating step, the actual operating rate of the drum is higher than or equal to 50%, and may be higher than or equal to 80%. Heating in this embodiment is different from heating the fabrics by heating the wash water and supplying the heated wash water to the fabrics. In other words, the drum is directly heated to simultaneously heat the fabrics and the wash water. Since the drum is directly heated, not the heater immersed in the wash water, the heater protection level is meaningless in this embodiment. Therefore, the actual operating rate may be very high in the heating step.

This means that mechanical force can be further provided to the fabrics to increase the washing effect. In addition, the fabrics and the wash water may be heated evenly. Due to the characteristics of the heating mechanism, the water level, driving of the circulation pump and driving of the drum in the heating step, the heating step in this embodiment may provide a very effective heating efficiency and washing efficiency.

In the heating step, the driving of the drum may include tumbling driving and filtration driving.

In the heating step, the driving of the drum may include circulation driving of performing the tumbling driving and the filtration driving in succession.

In the fabrics soaking step, the drum may be subjected to tumbling driving in a first half of a period for operating the circulation pump, and be subjected to filtration driving in a second half of the period.

In another aspect of the present invention, provided herein is a laundry apparatus including a tub configured to accommodate wash water, a drum rotatably provided in the tub, the drum accommodating fabrics therein, a motor configured to driving the drum, an induction heating module mounted on the tub to heat the drum through induction heating, a circulation pump configured to pump the wash water inside the tub and supply the pumped wash water into the drum, a water supply valve configured to supply wash water into the tub, a water level sensor configured to sense a water level of the wash water in the tub, and a controller configured to control driving of the motor, the induction heating module, the circulation pump, and the water supply valve, wherein the controller is configured to control the wash water to be supplied through the water supply valve until a water level of the wash water sensed by the water level sensor reaches a target water level, the target water level being lower than a lowest end of the drum, and to control the drum and the circulation pump to be driven after the target water level is reached.

After the target water level is reached, the heating step and the main washing step may be performed. The drum, the circulation pump and the induction heating module may be driven in the heating step. Additional water supply may not be performed after the target water level is reached.

When the water supply is finally terminated in the washing operation, the heating step may be performed. The controller may control the heating step to be performed after the final termination of the water supply. In the heating step, the controller may control the circulation pump and the induction heating module to be driven in a period in which the drum is driven.

In this embodiment, the controller performs water supply control through the water supply valve and the water level sensor, control of driving of the induction heating module, control of driving of the drum, and control of driving of the circulation pump, to implement a laundry machine that provides a very effective washing method.

In another aspect of the present invention, provided herein is a method of controlling a laundry apparatus including a tub, a drum, an induction heating module mounted on the tub to heat the drum through induction heating, and a circulation pump configured to pump wash water inside the tub and supply the pumped wash water to an upper portion of the drum, the method including: a water supply step of supplying wash water into the tub through a water supply valve, a fabrics soaking step of circulating the wash water by operating the circulation pump and performing fabrics soaking by driving the drum after termination of the water supply step, a heating step of performing heating by driving the induction heating module after termination of the fabrics soaking step, and a main washing step of performing washing by driving the drum after termination of the heating step, wherein the heating step is performed when a water level of the wash water is lower than a lowest end of the drum, wherein the drum, the circulation pump and the induction heating module are driven to heat the drum, the wash water and the fabrics in the heating step.

In another aspect of the present invention, provided herein is a method of controlling a laundry apparatus including a tub, a drum and an induction heating module mounted on the tub to heat the drum through induction heating, the method including a water supply step of supplying wash water into the tub through a water supply valve, and a heating step of performing heating by driving the induction heating module after termination of the water supply step, wherein, in the heating step, driving of the drum and driving of the induction heating module are controlled to be operatively connected to each other, wherein a period for driving the drum includes a period for driving the induction heating module, and the driving of the induction heating module is excluded outside the period for driving the drum.

Features of the above-described embodiments may be implemented in combination in other embodiments unless they are contradictory or exclusive of each other.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 10 illustrates a correlation between washing performance, the amount of water, a washing temperature, wash water circulation, and drum driving in a conventional laundry apparatus; and FIG. 11 illustrates a correlation between washing performance, the amount of water, a washing temperature, wash water circulation, and drum driving in the laundry apparatus according to the embodiment of the present invention.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a laundry apparatus and a control method thereof according to an embodiment of the present invention will be described in detail with reference to the accompanying drawings.

The applicant has filed a patent application (Korean Patent Application No. 10-2017-0101332, hereinafter referred to as "prior art patent document") for a laundry apparatus having an induction heating module as a laundry apparatus applicable to one embodiment of the present invention.

Accordingly, elements not described herein may be the same as or similar to those disclosed in the prior art patent document, unless they contradict the prior art patent document.

Therefore, a detailed description of a cabinet defining the exterior of the laundry apparatus, a tub provided in the cabinet, a drum rotatably provided in the tub, and a door rotatably provided to the cabinet are omitted. In addition, a detailed description of the heating principle and structural features of the induction heating module will be omitted.

Figure 1:
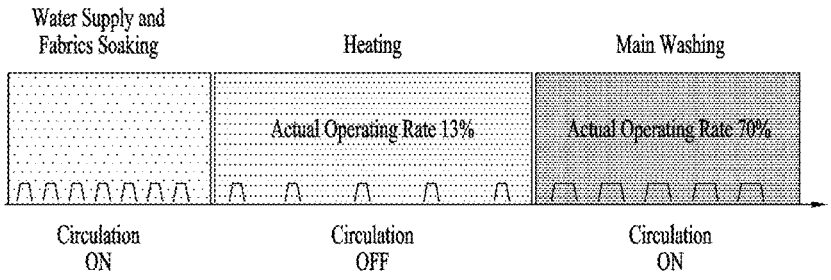
FIG. 1 illustrates driving of a drum and a circulation pump in a washing operation of a conventional laundry apparatus.
Figure 2:
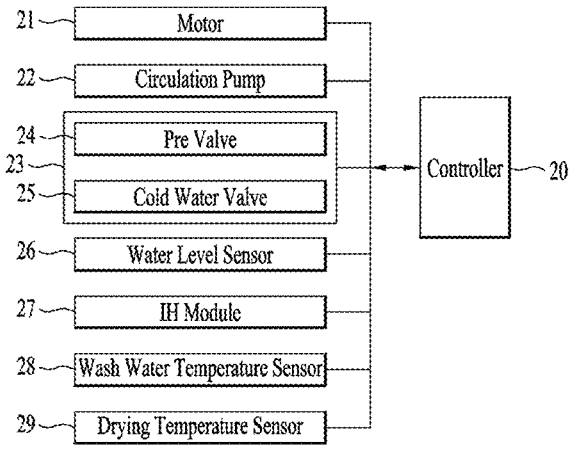
FIG. 2 illustrates control elements of a laundry apparatus according to an embodiment of the present invention.

First, control elements of the laundry apparatus according to an embodiment of the present invention will be described in detail with reference to FIG. 2.

A controller 20 is provided as a main processor to control operation of the laundry apparatus. Operation of various control elements which will described later may be controlled by the controller.

A motor 21 is provided to drive the drum. That is, the motor 21 is provided to rotate the drum. The rotational force of the motor 21 may be transmitted directly or indirectly to the drum. Recently, a direct drive motor whose rotational force is directly transmitted to the drum is commonly used as the motor 21.

The driving pattern of the drum may vary according to the driving pattern of the motor 21. Therefore, the controller 20 controls driving of the motor 21 to generate various kinds of driving including tumbling driving, filtration driving, and spin driving of the drum. The driving of the drum may be referred to as motion of the drum.

The time for which the motor is actually driven within a certain period may correspond to an actual operating rate.

That is, if the motor is actually driven for only 50 seconds within the period of 100 seconds, the actual operating rate of the motor may be 50%. Since the motor drives the drum, the actual operating rate of the motor may be approximately equal to the actual operating rate of the drum. In this embodiment, the actual operating rate of the motor and the actual operating rate of the drum may be understood to be the same unless otherwise described.

The tumbling driving of the drum causes the fabrics inside the drum to be lifted and then fall as the drum rotates at approximately 40 to 46 RPM. In the tumbling driving, washing or fabrics soaking may be performed by mechanical force according to fall of the fabrics and friction against the drum. Since the fabrics are agitated in the drum through the tumbling driving, the tumbling driving may be commonly used.

In the filtration driving of the drum, the drum and the fabrics may integrally rotate with the fabrics making close contact with the inner circumferential surface of the drum as the drum rotates at approximately 100 RPM. In this driving, the laundry fabrics are spread on the inner circumferential surface of the drum and wash water is separated from the fabrics.

In the spin driving of the drum, wash water may be removed from the fabrics by centrifugal force as the drum rotates at about 800 or higher RPM. The spin driving may be performed by very large centrifugal force in the final process of washing, and then washing may be finished.

Therefore, the RPM of the drum increases from the spin driving to the filtration driving to the tumbling driving. In the spin driving, the drum may be continuously rotated in one direction. In the tumbling driving and the spin driving, forward and reverse rotation and stopping may be repeated.

For washing, the wash water should be supplied from the outside of the laundry apparatus into the tub. To this end, the laundry apparatus is provided with a water supply valve 23. The water supply valve is connected to an external water supply, and wash water is supplied into the laundry apparatus when the water supply valve is operated.

If necessary, a plurality of water supply valves 23 may be provided. A cold water valve 25, which is configured to supply cold water from an external water supply source, and a pre-valve 24 connected to a boiler to supply water other than cold water, such as hot water, may be provided.

When the wash water temperature is set to room temperature (cool or cold water), heating of the wash water is not required during washing. Therefore, in this case, water may be supplied only by the cold water valve 25. However, when the wash water temperature is set to a constant temperature (25° C., 40° C., etc.), not the room temperature, wash water may be supplied through the pre-valve 24 and the cold water valve 25. Of course, in the latter case, wash water may be supplied only through the cold water valve 25.

The pre-valve 24 and the cold water valve 25 may be used to supply the same cold water. Supplying water through the pre-valve 24 may correspond to a case where water is supplied to the tub through the drum, and supplying water through the cold water valve 25 may correspond to a case where water is supplied to the tub without passing through the drum. Of course, supplying water through the valves may refer to the opposite cases.

In addition, the pre-valve 24 may be a water supply valve for supplying wash water to the tub through the detergent box, and the cold water valve 25 may be a water supply valve for supplying wash water directly into the tub without passing through the detergent box. Of course, the valves may be used in the opposite way.

Therefore, a plurality of water supply valves may be provided according to the temperature of the wash water and the water supply path of the wash water.

A water level sensor 26 may be provided to sense the level of wash water supplied into the tub. That is, it may be a sensor configured to control the water level such that an appropriate amount of wash water is supplied.

In general, a frequency sensor configured to sense the water level through the frequency is commonly used as the water level sensor 26. The water level is sensed based on the difference between frequencies sensed according to the water levels. In the washing operation, the water level sensor 26 senses a water level for water supply, which is between a zero water level and the maximum water level. As described above, the maximum water level is a level for protecting the heater, at which a part of the lower portion of the drum is submerged in the wash water. It is common to supply water until the water level of the wash water reaches the heater protection water level after the fabrics fully absorbs wash water.

In this embodiment, the heater protection water level may be destroyed. That is, the heater protection water level may be ignored. Accordingly, the maximum water level at which water is supplied may be a water supply water level, not the heater protection water level. In this embodiment, the water supply water level may be a water level at which a part of the lower portion of the drum is submerged in the wash water.

In the frequency sensor, the zero water level may correspond to approximately 25.5 kHz and the heater protection water level may correspond to approximately 24.7 kHz. Of course, the value of a specific frequency may depend on the size of the laundry apparatus, the model of the frequency sensor, and the external environment. In any case, a higher frequency may mean a lower water level in the frequency sensor.

The controller 20 controls operation of the water supply valve 23 based on the water level value sensed by the water level sensor 26.

The induction heating (IH) module 27 may be a heater configured to heat the drum through induction heating. Since the IH module is described in detail in the prior art patent document, a redundant description thereof will be omitted.

Wash water is heated when the drum is heated by the IH module. Of course, the fabrics in contact with the drum as well as the wash water are directly heated. This heating method may increase the heating effect as the fabrics having absorbed the wash water are directly heated. In addition, since heat is less diffused to the surroundings, the heating efficiency may be enhanced.

In washing, heating through the IH module may be performed through the wash water temperature sensor 28. That is, heating may be terminated when the temperature of the wash water reaches a set temperature.

By the IH module, the drum may be heated to about 160° C. in a short time. In one example, the temperature of the outer circumferential surface of the drum may rise to 160° C. in about three seconds. Therefore, the heat of the drum should be transferred to the wash water and the fabrics to prevent the drum or the IH module from overheating.

In order to prevent the drum from overheating, a drying temperature sensor 29 may be provided. The drying temperature sensor 29 may be provided to directly or indirectly sense the temperature of the outer circumferential surface of the drum. When it is determined by the drying temperature sensor 29 that the drum is overheated, the controller 20 stops the operation of the IH module.

The wash water temperature sensor 28 may be mounted under the tub to sense the temperature of the wash water. The drying temperature sensor may be mounted on the top of the tub to sense the temperature of the outer circumferential surface of the drum. Accordingly, both sensors may be arranged at different positions and have different sensing targets.

The wash water temperature sensor 28 may directly sense the temperature of the wash water. The drying temperature sensor 29 may indirectly sense the temperature of the rotating drum in a non-contact manner. Accordingly, both sensors may employ different sensing mechanisms or methods.

The wash water temperature sensor 28 may be configured to sense the temperature of the wash water when the drum is stopped. The IH module may be controlled not to operate when the target temperature is reached. The drying temperature sensor 29 may be configured to sense the temperature of the drum when the drum rotates. In particular, it may be configured to sense the temperature during rotation of the drum and operation of the IH module. Accordingly, both sensors may operate at different sensing times.

Through such a dual sensor configuration, a safe laundry apparatus and a control method thereof may be provided.

One embodiment of the present invention may provide a laundry apparatus capable of stably driving the IH module and a control method thereof. In particular, driving of the drum may be operatively connected to driving of the IH module. Details of this embodiment will be described later.

With the laundry apparatus and the control method according to this embodiment, effective washing may be performed with wash water whose amount is significantly smaller than the amount of wash water needed for washing in conventional cases. That is, effective washing may be performed only by the amount of wash water up to a level much lower than the heater protection water level.

In order for washing to be effective, the fabrics should be supplied with sufficient detergent water (wash water in which detergent is dissolved). That is, washing may be performed when the fabrics cam absorb and discharge the detergent water at the same time. It will be clear that a portion of the fabrics that is not wet will not be washed. This may be reason why washing is performed at the heater protection water level in the conventional cases.

However, the heater protection water level is not required in this embodiment, and washing may be performed at a level much lower than the heater protection water level. That is, washing may be performed without the fabrics submerged in the wash water.

In this case, as the drum is driven, the detergent water absorbed by the fabrics is inevitably discharged to the tub, which may reduce the washing effect. For this reason, in this embodiment, a circulation pump 22 configured to supply or resupply the detergent water to the fabrics may be provided.

The circulation pump 22 may be an element configured to drain and pump a part of wash water from the lower portion of the tub to spray the wash water onto the fabrics from the top of the drum. The washing effect may be enhanced by the spray pressure of the wash water, and the wash water (detergent water) may be resupplied to the fabrics to ensure that the fabrics always remain sufficiently wet. Thus, effective washing may be performed even when the fabrics are not submerged in the wash water.

Washing through the laundry apparatus may be performed through the initial water supply, fabrics soaking, heating, and main washing steps or periods. After the main washing, rinsing and spin-drying may be performed to finish washing. The entire washing process or washing course is automatically performed in the order of washing operation, rinsing operation, and spin-drying operation and then terminated.

Additional water may be supplied in the fabrics soaking step. This embodiment may achieve the above object when heating is performed in the washing operation. Features in the washing operation according to an embodiment of the present invention described below may be equally applicable to the rinsing operation unless contradictory or exclusive.

Figure 3:
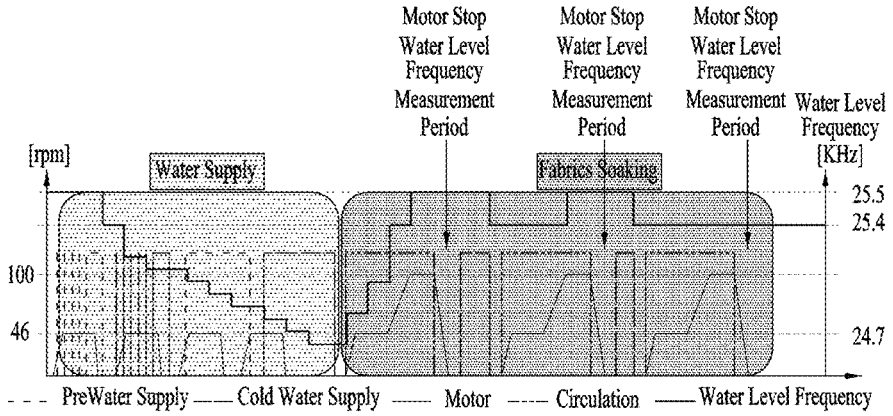
FIG. 3 illustrates operation of the control elements in a water supply step and a fabrics soaking step in the laundry apparatus according to the embodiment of the present invention.
Figure 4:
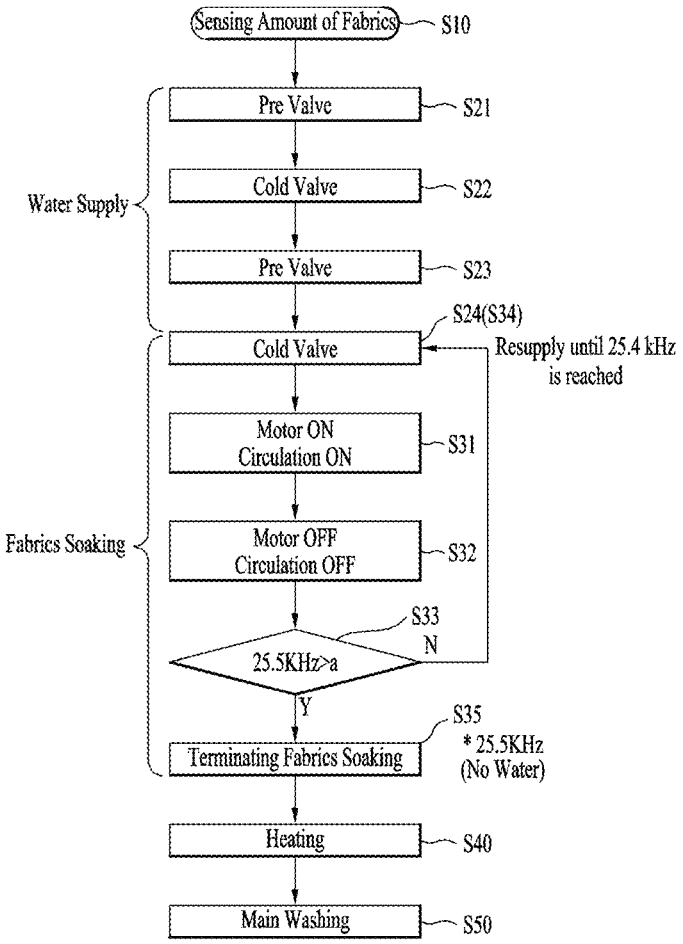
FIG. 4 illustrates a control flow of the laundry apparatus according to the embodiment of the present invention.

Hereinafter, a control method according to an embodiment of the present invention will be described in detail with reference to FIGS. 3 and 4. FIG. 4 illustrates the overall flow of the washing operation, and FIG. 3 illustrates operation of the control elements (the water supply valve, the motor to drive the drum, the circulation pump, and the water level sensor) in the washing operation, in particular, in the water supply and fabrics soaking periods (step).

The water supply and fabrics soaking periods will be described first.

When washing is started, sensing the amount of fabrics (S10) may be performed first while the drum is driven. As the sensed amount of fabrics increases, the amount of wash water needed may increase, and the time required for washing may also increase. Once the amount of fabrics is sensed, an expected end time of washing may be displayed according to the sensed amount of fabrics.

When the amount of fabrics is sensed, the water supply step S20 may be performed. The water supply step S20 may be initial water supply. In the water supply step S20, the drum may be subjected to tumbling driving. The RPM at this time may be approximately 46 RPM. When the motor is turned on, the RPM gradually increases, and the motor drives the drum while maintaining the set RPM, which is 46 RPM. When the motor is turned off, the RPM gradually decreases from 46 RPM to stop the drum. Thus, the drum rotates for a short time after the motor is turned off. When a predetermined time elapses after the drum stops rotating as the motor is turned off, the motor is turned on again. At this time, the drum may be rotated in the opposite direction.

In the water supply step S20, intermittent water supply may be performed by repeatedly turning on and off the water supply valve 23, or water may be supplied while keeping the valve turned on for a certain time. In the water supply step S20, water supply may be performed a plurality of times. A different on/off pattern or different On-state duration of the water supply valve 23 may be given each time water supply is performed. FIG. 2 illustrates an exemplary case where tumbling driving is performed for times and water supply is performed four times. The number of times of tumbling driving and the number of times of water supply may depend on the amount of fabrics.

In the water supply step S20, the water supply (S21) by the pre-valve 24 and the water supply (S22) by the cold water valve 25 may be sequentially performed. That is, pre-water supply (S21), cold water supply (S22), pre-water water supply (S23) and cold water supply (S24) may be performed. The final water supply in the water supply step (S20) may be cold water supply (S24).

As the water supply step S20 proceeds, the water level is increased. That is, the sensed water level frequency is reduced. In FIG. 2, 25.5 kHz is an example of the zero water level, 25.4 kHz is an example of a water level which is higher than the zero water level and is the minimum water level required in this embodiment (which is, for example, a level corresponding to about 1 liter, and is called a circulation water level in this embodiment). 24.7 kHz is an example of a conventional heater protection water level or a water level at which the low end of the drum is partially submerged in wash water.

In the water supply step S20, the initial water supply may be performed such that a large portion of the tumbling driving period overlaps with the water supply period. In other words, detergent water may be directly supplied to the fabrics to reduce the time for fabrics soaking later.

Dry fabrics take a certain amount of time to absorb the wash water. Therefore, a relatively small amount of the wash water supplied in the water supply step S20 is absorbed by the fabrics at the initial stage. Accordingly, when a target water level is reached the water supply step S20 is terminated. Here, the target water level may be a level similar to or lower than the conventional heater protection water level. Of course, the target water level may be a water level higher than the circulation water level. However, since it is expected that the water level will be lowered later through soaking of fabrics, the target water level may be set equal to the heater protection water level. Although not shown in FIG. 3, the water level may be sensed in the water supply process, which may be intended to determine the end time of the water supply process.

When the water supply step S20 ends at the target water level (approximately 24.7 kHz), the fabrics soaking step S30 is performed. The fabrics soaking step may be a step of allowing the fabrics to sufficiently absorb the wash water.

In this embodiment, the water level at the end of the water supply step S20 may be a water level at which the fabrics are not substantially submerged in the wash water. At this water level, only a part of the fabrics which is in contact with the lower portion of the drum may be submerged in the wash water. The fabrics soaking step S30 may be started while the drum is driven without additional water supply. Therefore, the circulation pump may be driven together with the drum for fabrics soaking.

That is, when the water supply step S20 finally ends with the water supply S24, the fabrics soaking step S30 may be started by turning on the motor and the circulation pump to drive the drum.

The water level at the end of the water supply step S20 may be higher than the circulation water level. Thus, the amount of wash water stored in the tub may be sufficient for circulation.

Driving of the drum may include tumbling driving. The driving of the drum may include filtration driving.

The tumbling driving may be performed for a predetermined time from the time at which the motor is turned on, and be followed by the filtration driving in succession. That is, rotation of the drum operating at 46 RPM for the tumbling driving may be increased and maintained at about 100 RPM for the filtration driving. The motor may be turned off when a predetermined time elapses. The driving of the drum in which the tumbling driving is followed by the filtration driving in succession may be referred to as circulation driving or circulation motion of the drum for convenience. That is, in the circulation driving of the drum, the tumbling driving and the filtration driving may be continuously performed in series.

Since the circulation pump is driven in the tumbling driving, which is the initial operation of the circulation driving, the water level gradually decreases. This is because the fabrics absorb wash water sprayed onto the fabrics as the circulation pump is driven. As the water level gradually decreases, the amount of wash water needed to drive the circulation pump may not be stored in the tub. Accordingly, in the filtration driving, which is the later operation of the circulating driving, a part of wash water sucked around the drum or excessively absorbed by the fabrics is removed. Wash water for the circulation pump driving may be secured by the filtration driving.

Most of the wash water is absorbed by the fabrics by the first time of the circulation driving of the drum and the circulation pump driving (S31), and thus the fabrics become wet. The wash water absorbed by the fabrics to a proper degree is not removed by centrifugal force because the RPM of the filtration driving is relatively low.

Thus, driving of the drum and the circulation pump is performed for the first time (S31), and driving of the drum and the circulation pump is terminated (S32) by turning off the motor and the circulation pump. The motor and the circulation pump may be synchronized. However, when the motor is turned off, the drum rotates for a short time and stops. This may take place due to inertia. When the drum is completely stopped after the motor is turned off, the water level is measured (S33). That is, this is intended to accurately measure the water level on the calm water surface. The water level after the first time of driving of the drum and circulation pump may be approximately the zero water level.

If the sensed water level is the zero water level or a water level lower than the circulating water level, for example, 25.5 kHz or higher than 25.4 kHz, additional water supply may be performed for the first time. The additional water supply may be water supply through the water supply valve 23 described above. That is, the water supply step S24 may be performed again through the valve that was turned on at the end of the water supply step S20, for example, the cold water valve S25. Thus, the additional water supply may be represented by S34 so as to distinguished from the water supply step S24 in fabrics soaking. The additional water supply S34 may be performed up to the circulation water level. That is, water supply may be performed until the water level sensor 26 senses, for example, 25.4 kHz.

After the additional water supply S33 is performed, driving of the drum and the circulation pump is performed for the second time (S31). Here, it may be seen that the water level at which driving of the circulation pump starts is the target water level of the additional water supply in the fabrics soaking step S30.

Driving of the drum and the circulation pump may be performed in the same manner as in the first time of the driving. The additional water supply S33 may be performed again when water level sensing is needed. Of course, the driving of the drum and the circulation pump may be restarted.

In the fabrics soaking step S30, driving the drum and circulation pump (S31), turning off the motor and circulation pump (S32), sensing the water level (S33), and the additional water supply (S34) may be continuously repeated. This repetition may be performed until the circulating water level is sensed in the water level sensing (S33) and additional water supply is not needed anymore. That is, the additional water supply is repeatedly performed until the circulation water level is reached. And when the water level is not reduced but is maintained at the circulation level, the fabrics soaking step is terminated.

In other words, when the water level sensed after the circulation driving is the circulation water level, the fabrics soaking step S30 is terminated (S35). That is, the fabrics soaking step S30 may be performed by the time at which the fabrics does not absorb wash water anymore despite spraying of wash water onto the fabrics through the circulation pump, the step of filling (S30) is carried out until the point at which (i.e., the time when absorption and discharge of the wash water is balanced in the fabrics).

When the lowest end of the drum touches the wash water, the amount of wash water supplied to the tub is approximately 2 liters, which correspond to, for example, 24.9 kHz. When a part of the lower portion of the drum is submerged in the wash water and a part of the fabrics inside the drum is submerged in the wash water, the amount of wash water supplied to the tub is approximately 3 to 4 liters, which correspond to, for example, 24.7 kHz. On the other hand, the circulation level is about 1 liter of wash water supplied to the tub. In other words, the amount of wash water corresponding to the circulation water level (e.g., 25.4 kHz) may be between the zero water level (e.g., 25.5 kHz) and 1 liter.

As described above, approximately 1.5 liters of wash water is needed to smoothly drive the circulation pump. However, 1.5 liters of wash water may be the amount of wash water present when the circulation pump is driven during the normal tumbling driving.

In this embodiment, the drum may be subjected to circulation driving when the circulation pump is driven. Since the filtration driving is implemented in the circulation driving, the washing water may be driven to gather in the lower portion of the tub, and therefore the circulation pump may be smoothly driven even with a relatively small amount of the wash water.

The circulation water level refers to wash water whose amount is smaller than the amount corresponding to the water level at which the lowest end of the drum touches the wash water by about 1 liter and is smaller than the amount corresponding to the heater protection water level by about 2 to 3 liters. In addition, the circulation water level may be a water level reached when approximately 1 liter of wash water is added at the zero water level.

Therefore, it may be seen that after completion of fabrics soaking, a relatively very small amount of wash water is stored in the tub. In other words, even if only a relatively small amount of wash water is supplied, fabrics soaking may be effectively performed, and heating or main washing subsequent thereto may also be performed.

In the conventional laundry apparatus, the amount of wash water reaching the heater protection water level is inevitably required after fabrics soaking. In this embodiment, only the amount of the wash water reaching the circulation level may be required after fabrics soaking. That is, it can be seen that the amount of residual wash water in the tub after fabrics soaking is remarkably small in this embodiment. It can be seen that the subsequent operations of wash water heating and main washing may be effectively performed even if wash water whose amount (less than 1 liter) smaller than the amount of wash water filling the circulation pump and the circulation channel (approximately 1.5 liters) remains after fabrics soaking.

In the circulation pump driving and the tumbling driving of the drum, approximately 1.5 liters may be left. By performing the filtration driving, approximately 1 liter may be left. In particular, by performing circulation driving through about 1 liter of residual wash water, the fabrics soaking effect may be enhanced and the circulation pump may be effectively driven.

Here, it can be seen that the amount of wash water required for washing is very effective for the washing effect and energy saving.

First, washing may be performed through high-concentration detergent water. When a large amount of wash water is needed, the amount of detergent is inevitably increased for the optimum-concentration detergent water. In many cases, washing will be performed at a concentration lower than the required concentration. However, in this embodiment, the amount of wash water may be reduced by approximately 2 to 3 liters, and therefore washing may be performed through detergent water of a very high concentration. Thereby, washing performance may be enhanced. When it is assumed that the laundry apparatus is used approximately 3 to 4 times a week, a considerable amount of water may be saved.

Next, the heating efficiency, which will be described later, may be improved. When wash water or the fabrics are heated, a lot of thermal energy is consumed to heat the wash water. This is because the thermal capacity of water is relatively large. Therefore, as the amount of wash water to be heated decreases, energy saving may be performed more effectively. That is, the amount of energy needed to heat water to the same temperature may be reduced, and a higher temperature may be reached by heating using the same amount of energy.

For example, 52° C. may be reached by heating, using the energy conventionally consumed to reach 40° C. by heating. Therefore, when the same energy is consumed, washing performance may be enhanced by a higher temperature.

For this reason, according to this embodiment, i the chemical washing effect may be enhanced by the detergent and a high temperature. In addition, the effect according to reduction of the washing time and the effect of enhancing washing by mechanical force may be more prominent in the heating step described below.

As shown in FIG. 4, the heating step S40 and the main washing step S50 may be performed after the fabrics soaking step S30.

Hereinafter, the heating step S40 that is performed after the fabrics soaking step S30 will be described in detail with reference to FIGS. 5 to 8.

Figure 5:
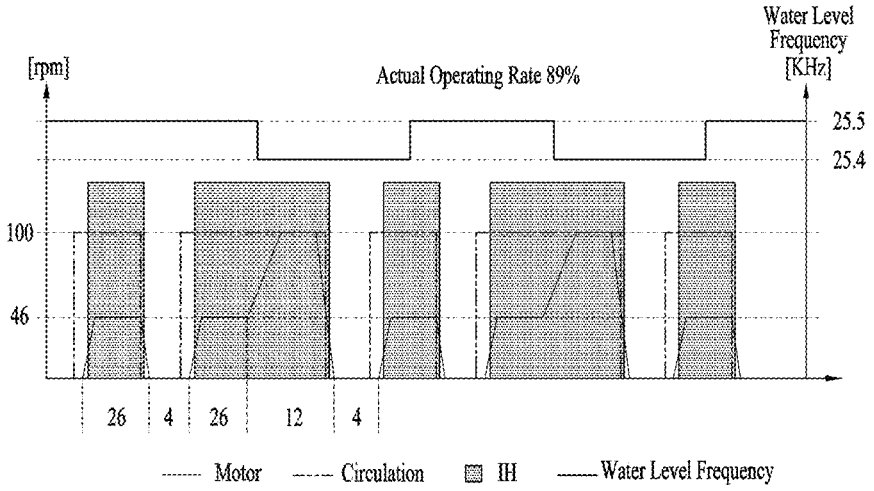
FIG. 5 illustrates operation of the control elements in a heating step in the laundry apparatus according to the embodiment of the present invention.
Figure 6:
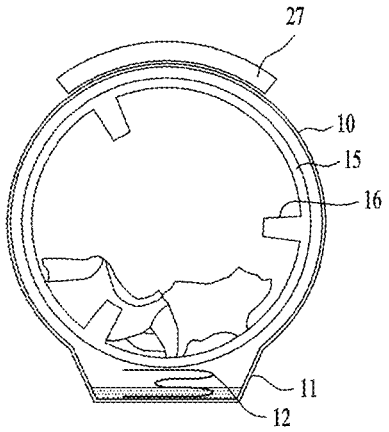
FIG. 6 illustrates a drum which is stopped.
Figure 7:
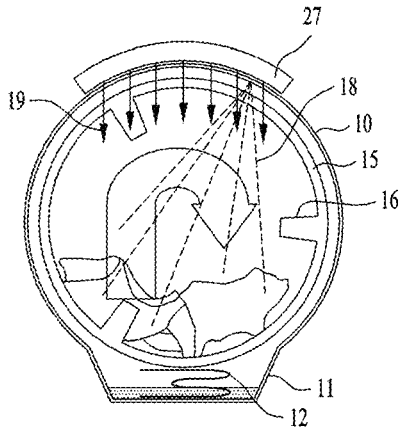
FIG. 7 illustrates tumbling operation of the drum.
Figure 8:
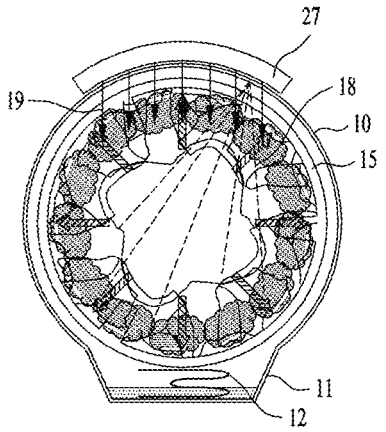
FIG. 8 illustrates filtration operation of the drum.

FIG. 5 illustrates operation of the motor and the IH module of the circulation pump and change in water level in the heating step. FIGS. 6 to 8 illustrate stopping of the drum, the tumbling driving and the filtration driving, respectively.

In this embodiment, unlike the example in FIGS. 6 to 8, the heater mounting portion 11 of the tub 10 may not be formed, and the heater 12 may not be mounted. However, the conventional tub may be used without changing the design, and the heater 12 is shown because the heater can be used outside the heating period. The heater 12 is shown to clarify that the heater protection water level can be destroyed or ignored in this embodiment.

In the fabrics soaking step S30, Water supply is completed and fabrics soaking is completed. That is, no further water supply may be performed and the fabrics may have absorbed the wash water to the maximum degree.

After the fabrics soaking step S30, the heating step S40 may be performed to enable washing at a high temperature. In the heating step S40, the drum is heated through the IH module 27. Therefore, the operation of turning on the IH module may always be performed while the drum is rotating.

As shown in FIG. 6, when the drum is stopped, the IH module 27 may be turned off. Driving the circulation pump may also be stopped. The IH module 27 may be provided at the top of the tub, and the fabrics are not placed on the upper side of the drum facing the IH module 27. Thus, a specific part of the drum may be overheated with the drum stopped. This is because heat cannot be transferred to the fabrics or wash water. Therefore, the IH module 27 may be turned off whenever the drum is stopped.

In the heating step S40, the drum is driven to uniformly heat the wash water and the fabrics. The driving of the drum may include tumbling driving and filtration driving. In addition, the driving of the drum may include tumbling driving and circulation driving. The tumbling driving and the circulation driving may be performed sequentially or alternately.

As shown in FIG. 7, as the drum rotates during the tumbling driving, the fabrics may be lifted by the lifter 16 and then fall due to gravity, and circulation water may be sprayed into the drum. In addition, the IH module may be driven to heat the drum.

As shown in FIG. 8, in the filtration driving or in the filtration driving within the circulation driving, as the drum rotates, the fabrics may come into close contact with the inner circumferential surface of the drum and integrally rotate together with the drum. This is because the centrifugal force according to rotation of the drum is stronger than the gravitational force. At this time, the circulation water may be sprayed into the drum and the IH module may be driven to heat the drum.

FIGS. 7 and 8 illustrate that wash water 18 is circulated and sprayed into the drum from the top of the drum, and a magnetic field 19 varied by driving of the IH module is provided to the drum. Eddy current is generated in the drum by change of the magnetic field, and heat is generated by the eddy current.

Thus, as shown in FIGS. 6 to 8, the heater protection water level may be destroyed in the entire heating period, and thus the water level may always be lower than the lowest end of the lower portion of the drum, that is, the circulation level.

In the tumbling driving and the circulation driving, the IH module 27 and the circulation pump 22 may operate. Wash water is sprayed onto the heated fabrics and drum by operation of the circulation pump 22. Thus, the heat of the heated drum may be effectively transferred to the wash water and the fabrics. That is, the driving of the drum, heating and driving of the circulation pump are performed at the same time.

As shown in FIG. 5, the period from the start of rotation of the drum to the stop of rotation of the drum may be the same as the circulation pump operation period. Since the circulation pump may be operated synchronously by turning on the motor, rotation of the drum and operation of the circulation pump may be started substantially at the same time. However, when the motor is turned off, the inertia force causes the drum to rotate for a short time to stop. Thus, the circulation pump may be turned off synchronously when the motor is off. Of course, the circulation pump may be turned off when the drum is stopped.

A period in which the drum starts and stops rotating may be the same as a period in which the IH module is turned on and off. However, the IH module may start to be turned on after the start of rotation of the drum, and may be turned off before rotation of the drum is stopped.

Therefore, the driving period of the drum may basically include or be the same as the driving period of the circulation pump and the driving period of the IH module.

When the motor is turned on, the rotational speed of the drum increases to a target speed and the drum rotates maintaining target speed. If the rotational speed of the drum is low, some areas of the drum may be rapidly heated. Therefore, the IH module may be turned on only when the rotational speed of the drum is higher than a certain speed after the motor is turned on. Thereby, the drum may be prevented from overheating.

Similarly, it is not desirable for the IH module to be kept on until the drum has come to a complete stop. This is because some areas of the drum may be heated rapidly at the time when the drum is stopped. Therefore, the IH module may be turned off when the rotational speed of the drum is lower than a certain speed after the motor is turned off. It is not desirable to turn off the IH module after the motor is turned off. Since the drum rotates due to inertial force, heating may be performed in the entire inertial rotation period to reduce the entire heating time. In addition, the IH module may need to be turned off when the speed of the drum decreases to a certain speed before the drum is completely stopped. Here, the rotational speed of the drum at which the IH module is turned on during acceleration of rotation of the drum may be the same as the rotational speed of the drum at which the IH module is turned off during deceleration of rotation of the drum. This speed may be about 15 RPM. That is, the same threshold RPM may be given. Lowering the threshold RPM may improve heating efficiency, but increase the risk of overheating. Conversely, increasing the threshold RPM may reduce the heating efficiency, but decrease the risk of overheating. Accordingly, the operation of the IH module may be controlled by setting the RPM corresponding to about ⅓ of the tumbling RPM as the threshold RPM.

Therefore, the on/off timing of the motor may be different from the on/off timing of the IH module.

According to this embodiment, in the heating step S40, the heater protection water level is meaningless as described above. As can be seen from FIG. 5, effective heating may be performed even when the water level is changed between the zero water level and the circulation water level in the heating period. The illustrated change in water level is merely an example and may vary between the zero water level and the circulation water level in a different form. When the heating target temperature of the wash water is lower than about 60° C., the amount of evaporated water is not large. This is because evaporation and condensation occur simultaneously.

According to this embodiment, prevention of overheating in the laundry apparatus may be implemented through control of driving of the IH module regardless of the amount of wash water. Accordingly, in the heating step S40, the actual operating rate of the motor may be greatly increased. For example, it may be increased to 80% or more up to approximately 90%. This rate is very high compared to the actual operating rate in the heating period of the conventional laundry apparatus, which is about 13%.

It can be seen that by increasing the actual operating rate, more mechanical force may be provided to enhance the washing effect. In addition, the washing temperature may be reached very quickly due to the characteristics of the IH module. That is, the mechanical force and the heating efficiency may be increased, energy may be saved, and the amount of heating time may be reduced.

In the heating step S40, the drum may be subjected to tumbling driving and circulation driving. The drum may temporarily stop after the tumbling driving, and then the circulation driving may be performed. This driving pattern may be repeated. That is, the heating step S40 may be performed through repetition of the driving pattern until the target temperature is sensed by the wash water temperature sensor.

In the heating step S40, the water level may vary between the zero water level and the circulation water level.

When only the tumbling driving is performed, a relatively large amount of wash water is needed to drive the circulation pump as described above. When the filtration driving is performed, heat may be excessively transferred to the fabrics, thereby causing thermal damage to the fabric. Therefore, performing only the tumbling driving or both the tumbling driving and the filtration driving in an alternating manner may not be preferable.

In this embodiment, the tumbling driving and the circulation driving may be repeated. Accordingly, if the circulation pump can be driven even with a relatively small amount of wash water, the fabrics may be effectively heated while preventing overheating of the fabrics.

In the circulation driving, the tumbling time may be longer than the filtration time.

As the tumbling time increases, the fabrics and the wash water may be evenly heated, and the washing effect according to heating may be increased. In this case, however, wash water for circulation may be insufficient. Therefore, the filtration driving should be performed for a proper time. As the filtration driving time increases, there is less concern about lack of wash water for circulation. However, the time for which the fabrics remain in close contact with the drum may increase, and thus the fabrics may overheat.

Therefore, in order to prevent overheating of the fabrics, to secure a sufficient amount of wash water for driving the circulation pump, and to improve heating and washing performance, the tumbling time and the filtration time should be appropriately assigned. FIG. 5 exemplarily illustrates repetition of a 26-second period of the tumbling driving, a 4-second period of pause, and a 38-second period of the circulation driving. FIG. 5 also exemplarily illustrates that the tumbling driving is performed for 26 seconds and the filtration driving is performed for 12 seconds during the circulation driving. According to this embodiment, the tumbling time may be longer than the filtration time, and specifically, be longer than or equal to twice the filtration time. In addition, the tumbling driving and the circulation driving may be performed alternately.

Hereinafter, an embodiment for preventing overheating in the heating step will be described in detail with reference to FIG. 9.

When the water supply is finished, the drum may be heated by driving the IH module. The fabrics accommodated in the drum may be heated by the heated drum.

The IH module faces only a part of the outer circumferential surface of the drum. Accordingly, when the IH module is driven with the drum stopped, only a certain part of the drum may be heated. In particular, when the IH module faces the top of the drum, it is difficult for heat to be transferred from the heated drum to the fabrics or wash water. Therefore, in this embodiment, driving of the drum and driving of the IH module may basically be operatively connected to each other. In particular, the driving period of the drum may include or be the same as the driving period of the IH module.

The drum accelerates when the motor is turned on and starts to be driven. The drum decelerates to stop when the motor is turned off. Therefore, the RPM at the start and end of the driving is very low. Therefore, the IH module may not be driven at the start and end of the driving.

Figure 9:
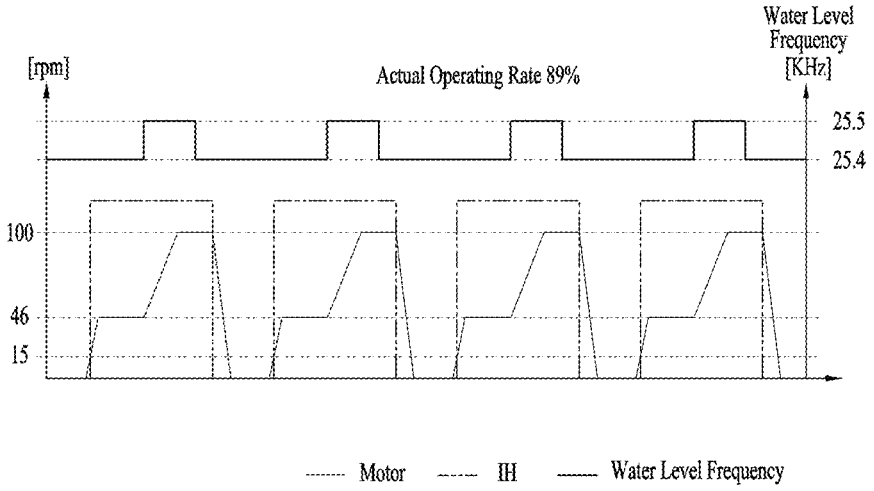
FIG. 9 illustrates a relationship between driving of the drum and driving of an induction heating module for safe driving of the induction heating module.

In the example illustrated in FIG. 9, the IH module is driven when the drum accelerates to reach approximately 15 RPM. Similarly, the IH module may be turned off when the drum decelerates to reach approximately 15 RPM. In the acceleration of the drum, the IH module may be driven since the RPM of the drum is expected to increase later. In the deceleration of the drum, on the other hand, the RPM of the drum is expected to decrease later. Therefore, the turn-off timing of the IH module may be synchronized with the turn-off timing of the motor. This is because heating the drum is ultimately intended to heat the fabrics and wash water, rather the drum.

Through the correlation between the drum and the driving period of the IH module, effective heating may be ensured and overheating of the drum may be prevented. Overheating of the fabrics may also be prevented.

In FIG. 9, the driving of the circulation pump is not shown. However, the driving of the circulation pump illustrated in FIG. 5 may be applied to this example in the same manner.

The driving period of the circulation pump may be set to be substantially the same as the driving period of the IH module. This is because wash water is delivered to the drum and the fabrics by the circulation pump. Since wash water, whose temperature is low, is supplied to the drum, which is at the highest temperature, overheating of the drum and fabrics may be prevented.

It may be further necessary to improve stability as well as control of the IH module by operative connection between driving of the IH module and driving of the drum and/or the circulation pump. To this end, the drying temperature sensor described above may be provided.

When the IH module is being driven, the IH module may be forcibly turned off if the drying temperature sensor senses the drum overheating. That is, even when the IH module is driven in operative connection with driving of the drum, it may be forcibly turned off. Of course, the drum may continue to be driven at this time.

For example, in driving of the drum for which the motor is set to be kept on for 36 seconds, when overheating of the drum is sensed by the drying temperature sensor at a time point of 30 seconds from the start time, driving of the IH module may be turned off immediately. And the motor may remain in the On state for the remaining 6 seconds. In other words, if driving of the drum is maintained when the IH module is forcibly turned off, heat may be effectively transferred to the fabrics and wash water. In addition, driving of the circulation pump may also be controlled in a similar manner to driving of the drum. In other words, the drum and the circulation pump may be controlled to be driven for a predetermined time even if the IH module is forcibly terminated.

Hereinafter, washing performance (shown in FIG. 10) of the conventional laundry apparatus and washing performance (shown in FIG. 11) according to this embodiment will be compared with reference to FIGS. 10 and 11. In particular, the results of washing performance obtained based on the amount of wash water, washing temperature, and driving of the circulation pump and the drum in the heating period are compared with each other.

The fourth column of FIG. 10 shows washing performance and conditions in general washing of a conventional laundry apparatus.

In the heating period, wash water is heated to 40° C. and the general washing condition for the amount of wash water needed in addition to fabrics soaking is approximately 2 to 4 liters. As described above, in this case, driving of the circulation pump should be limited or excluded regardless of the driving pattern of the drum. Under the general washing conditions, the washing performance is 100%, which may be referred to as reference washing performance.

As can be seen from the second and third columns, the heating period may not be present as the amount of the wash water is smaller than the reference condition, and thus the driving of the circulation pump may be limited regardless of the driving pattern of the drum. Therefore, the washing performance is inevitably lower than the reference washing performance.

As can be seen from the fifth column, as the amount of wash water is larger than the reference condition, the circulation pump may be driven in the heating period regardless of the driving pattern of the drum. Since the amount of wash water increases, the washing temperature will be about 34° C., which is lower than 40° C., when the same energy is used. Therefore, since the wash water temperature is low and the concentration of the detergent is low, the washing performance is inevitably lower than the reference washing performance.

The fourth column of FIG. 11 shows washing performance and conditions in general washing of the laundry apparatus according to this embodiment. The difference in washing performance from the reference conditions of the conventional laundry apparatus described above is not large. This is because the circulation pump can be driven in the heating period and the actual operating rate of the motor can be increased under a similar temperature condition and detergent concentration conditions to the conventional case. Of course, the case of the fifth column may be similar to this case.

However, it can be seen that the amount of wash water needed according to this embodiment is smaller than the amount of wash water needed in the conventional laundry apparatus, and that the heating may be performed with only 0 to 1 liter of wash water. These conditions are also shown in the third column, which may be the optimum conditions in this embodiment.

Since the amount of wash water is small, the washing temperature may be further increased with the same energy and the detergent concentration may be increased. In addition, the circulation pump may be driven according to the driving pattern of the drum. Therefore, very economical and effective washing may be performed and, and higher performance of washing may be exhibited.

Of course, when there is little residual water as shown in the drawing, the heating temperature may be increased, resulting in washing performance similar to the reference performance.

As described above, according to this embodiment, washing logic or washing conditions that cannot be implemented in the conventional laundry apparatus may be implemented, thereby enabling very economical and effective washing.

As is apparent from the above description, the present invention has effects as follows.

In one embodiment of the present invention, a laundry apparatus capable of increasing efficiency of fabrics soaking by driving a circulation pump in a period of fabrics soaking even when the amount of supplied wash water is small, and a control method thereof may be provided.

According to one embodiment of the present invention, a laundry apparatus capable of shortening the time needed for fabrics soaking while effective performing fabrics soaking, and a control method thereof may be provided.

According to one embodiment of the present invention, a laundry apparatus capable of improving washing performance and reducing energy consumption by increasing the actual operating rate of a drum and the actual operating rate of a circulation pump in a wash water heating period by destroying a heater protection water level, and a control method thereof may be provided.

According to one embodiment of the present invention, a laundry apparatus capable of enhancing washing performance by driving a circulation pump in a wash water heating period, and a control method thereof may be provided.

According to one embodiment of the present invention, a laundry apparatus capable of securing washing performance and saving energy by reducing energy needed to heat wash water, and a control method thereof may be provided.

According to one embodiment of the present invention, a laundry apparatus capable of performing washing using a small amount of wash water and high-concentration detergent water, and a control method thereof may be provided.

According to one embodiment of the present invention, a laundry apparatus capable of safely heating wash water despite the destruction of a heater protection water level, and a control method thereof may be provided.

According to one embodiment of the present invention, a laundry apparatus capable of heating a drum through an induction heating module and heating wash water through the heated drum, and a control method thereof may be provided.

According to one embodiment of the present invention, a laundry apparatus capable of preventing fabrics from being overheated and damage by substantially equalizing the heating period of the induction heating module and the heating period of the circulation pump, and a control method thereof may be provided.

According to one embodiment of the present invention, a safe laundry apparatus capable of effectively preventing overheating of the drum by substantially equalizing the heating period of the induction heating module and the rotation period of the drum or including the heating period in the rotation period of the drum, and a control method thereof may be provided. In addition, a laundry apparatus capable of preventing overheating of the drum through a drying temperature sensor capable of sensing the temperature of the drum, and a control method thereof may be provided.

According to one embodiment of the present invention, a safe laundry apparatus capable of preventing overheating through an induction heating module and a control method thereof may be provided. In addition, a laundry apparatus capable of enhancing the heating efficiency and washing efficiency by increasing a time for which the induction heating module is driven (i.e., an actual operating rate of the induction heating module) in a heating period, and a control method thereof may be provided.

According to one embodiment of the present invention, a laundry apparatus capable of preventing an induction heating module from overheating a drum by controlling driving of the drum and the circulation pump to be operatively connected to each other, in particular by operatively connecting the driving of the drum with the driving of the circulation pump, and a control method thereof may be provided.

According to one embodiment of the present invention, a safe laundry apparatus capable of forcibly stopping driving an induction heating module when overheating of the drum is sensed through a drying temperature sensor for detecting overheating of the drum, and a control method thereof may be provided. In particular, a laundry apparatus capable of quickly addressing overheat of the drum by maintaining scheduled driving of the drum and/or the circulation pump when the induction heating module is forcibly stopped, and a control method thereof may be provided.

According to one embodiment of the present invention, a safe laundry apparatus capable of preventing overheating by the induction heating module through a drying temperature sensor and a wash water temperature sensor for detecting the temperature of wash water, which are installed at different positions, targeting different objects, and operate at different sensing times, and a control method thereof may be provided.

It will be apparent to those skilled in the art that various modifications and variations can be made in the present invention without departing from the spirit and scope of the invention. Thus, it is intended that the present invention cover the modifications and variations of this invention provided they come within the scope of the appended claims and their equivalents.

What is claimed is:

1. A method of controlling a laundry apparatus, the method comprising:

supplying, in a water supply step and through a water supply valve of the laundry apparatus, wash water into a tub of the laundry apparatus;

circulating, in a fabric soaking step that occurs after termination of the water supply step, the wash water by operating a circulation pump of the laundry apparatus and driving a drum of the laundry apparatus, wherein a water level of the wash water after termination of the fabric soaking step is a preset circulation water level;

heating, in a heating step that occurs after the termination of the fabric soaking step, the drum (i) by driving an induction heating module of the laundry apparatus and (ii) by maintaining the water level of the wash water after the termination of the fabric soaking step without additional water supply; and washing, in a main washing step that occurs after termination of the heating step, laundry by driving the drum.

2. The method of claim 1, wherein, in the water supply step, the water level of the supplied wash water is above a heater protection water level, wherein a lower portion of the drum is submerged in the supplied wash water.

3. The method of claim 2, wherein, in the water supply step, the water level of the wash water rises gradually based on the supplying of wash water being performed a plurality of times.

4. The method of claim 1, wherein the fabric soaking step comprises:

measuring a water level of the wash water, and based on the measured water level of the wash water being lower than the preset circulation water level, performing one or more additional water supply steps.

5. The method of claim 4, wherein a circulation water level refers to an amount of wash water that is smaller than or equal to an amount of wash water that fills a circulation path for driving the circulation pump, and wherein a lowest portion of the drum is not submerged in the wash water at the circulation water level.

6. The method of claim 5, wherein the amount of wash water at the circulation water level is less than 1.5 liters.

7. The method of claim 4, wherein the one or more additional water supply steps are performed until the water level of the wash water reaches the circulation water level.

8. The method of claim 7, wherein, during the measuring of the water level through the one or more additional water supply steps, the driving of the drum and the driving of the circulation pump are stopped.

9. The method of claim 4, wherein, in the fabric soaking step, the driving of the drum comprises tumbling driving and filtration driving.

10. The method of claim 9, wherein, in the fabric soaking step, the tumbling driving and the filtration driving are performed sequentially and repeatedly.

11. The method of claim 4, wherein, in the fabric soaking step, the driving of the drum comprises circulation driving that performs tumbling driving and filtration driving in series.

12. The method of claim 11, wherein, in the fabric soaking step, the circulation driving is performed a plurality of times simultaneously to the driving of the circulation pump.

13. The method of claim 12, wherein a turn on time of a motor of the laundry apparatus for the circulation driving is the same as a turn on time of the circulation pump, and a turn off time of the motor for termination of the circulation driving is the same as a turn off time of the circulation pump.

14. The method of claim 11, wherein, in the circulation driving, a time used for the tumbling driving is longer than a time used for the filtration driving.

15. The method of claim 1, wherein, in the heating step and the main washing step, no additional wash water is supplied through the water supply valve.

16. The method of claim 1, wherein the fabric soaking step is terminated based on the water level of the wash water being consistent after starting the driving of the drum and the circulation pump.

17. The method of claim 16, wherein the fabric soaking step is terminated at a circulation water level, wherein the circulation water level refers to an amount of wash water that is smaller than or equal to an amount of wash water that fills a circulation path for driving the circulation pump, and wherein the heating step and the washing step occur based on the water level of the wash water being at the circulation water level.

18. The method of claim 5, wherein a lowest portion of the drum is not submerged in the wash water at a water level of the heating step.

19. The method of claim 18, wherein the water level of the wash water in the heating step is lower than or equal to the circulation water level of the wash water.

20. The method of claim 19, wherein the amount of wash water in the tub is less than or equal to 1 liter to form the circulation water level in the heating step.

21. The method of claim 18, further comprising driving, in the heating step, the drum, the circulation pump, and the induction heating module simultaneously.

22. The method of claim 21, wherein a period of driving the drum overlaps a period of driving the circulation pump and a period of driving the induction heating module, and wherein the driving of the circulation pump and the driving of the induction heating module are stopped based on the drum being stopped.

23. The method of claim 21, wherein, in the heating step, the driving of the drum comprises tumbling driving and filtration driving.

24. The method of claim 23, wherein, in the heating step, the driving of the drum comprises circulation driving that performs the tumbling driving and the filtration driving in series.

25. The method of claim 1, wherein, in the fabric soaking step, the drum is configured for tumbling driving in a first half of a period of operating the circulation pump, and for filtration driving in a second half of the period of operating the circulation pump.

26. A laundry apparatus comprising:

a tub configured to accommodate wash water;

a drum rotatably located in the tub, wherein the drum accommodates laundry therein;

a motor configured to drive the drum;

an induction heating module located on the tub and configured to heat the drum through induction heating;

a circulation pump configured to pump the wash water into the tub and supply the pumped wash water into the drum;

a water supply valve configured to control the wash water supply into the tub;

a water level sensor configured to sense a water level of the wash water in the tub; and a controller configured to control the motor, the induction heating module, the circulation pump, and the water supply valve, wherein the controller is configured to:

supply wash water into the tub;

circulate the wash water by operating the circulation pump and drive the drum for soaking fabric after termination of the supply of wash water;

heat the drum by driving the induction heating module after termination of the circulation of the wash water; and wash laundry by driving the drum after termination of the heating of the drum, wherein a water level of the wash water after the termination of the circulation of the wash water is a preset circulation water level that is maintained during heating of the drum without additional water supply.

* * * * *